US005561452A

United States Patent [19]

East

[11] Patent Number: 5,561,452

[45] Date of Patent: Oct. 1, 1996

[54] CONTINUOUS INK JET PRINTING ELECTRODE ASSEMBLY

[75] Inventor: Amanda H. East, Cambridge, England

[73] Assignee: Videojet Systems International, Inc., Wood Dale, Ill.

[21] Appl. No.: 688,561

[22] PCT Filed: Jan. 12, 1990

[86] PCT No.: PCT/GB90/00053

§ 371 Date: Sep. 9, 1991

§ 102(e) Date: Sep. 9, 1991

[87] PCT Pub. No.: WO90/08037

PCT Pub. Date: Jul. 26, 1990

[30] Foreign Application Priority Data

Jan. 12, 1989 [GB] United Kingdom ..... 8900692

[51] Int. Cl.[6] ..... B41J 2/085

[52] U.S. Cl. ..... 347/76; 347/73

[58] Field of Search ..... 347/73, 74, 76, 347/79

[56] References Cited

U.S. PATENT DOCUMENTS

| | | | |
|---|---|---|---|
| 4,194,211 | 3/1980 | Hoffman et al. | 347/76 |
| 4,223,321 | 9/1980 | Kenworthy | 347/76 |
| 4,324,117 | 4/1982 | Schwob et al. | 347/74 X |
| 4,347,522 | 8/1982 | Bahl et al. | 347/76 |
| 4,378,631 | 4/1983 | Head et al. | 347/76 X |
| 4,419,674 | 12/1983 | Bahl et al. | 347/76 |
| 4,560,991 | 12/1985 | Schutrum | 347/76 |

*Primary Examiner*—Sandra L. Brase

*Attorney, Agent, or Firm*—Kokjer, Kircher, Bowman & Johnson

[57] ABSTRACT

A charging electrode assembly for a continous multi-jet ink jet printer includes a substrate plate 1 of electrically insulated material provided with a series of parallel electrodes 5 extending across an edge of the plate and a series of parallel strip leads 6 extending across a face of the plate. The plate is formed with grooves, plated with metal, and then the faces of the plate are ground to leave the electrodes and strip leads in the grooves. Alternatively, the surfaces of the plate are metal plated and then grooves are cut in the edge and face of the plate to leave the electrodes and strip leads between the grooves. An independent feature of the invention recides in the provision of one or more eccentric dowels working in elongate slots in the plate so that rotation of the dowels provides fine adjustment of the plate, and hence of the electrodes relatively to trains of ink droplets.

11 Claims, 2 Drawing Sheets

CONTINUOUS INK JET PRINTING ELECTRODE ASSEMBLY

BACKGROUND OF THE INVENTION

In one form of continous multi-jet ink jet printer, the ink jets, as they break up into coplanar trains of droplets, are passed adjacent to respective electrodes, in a face of a charging electrode. Each electrode is connected to a respective lead so that appropriate charging potentials can be provided in accordance with the charging programme to the individual jets.

In view of the small dimensions involved, there being typically four or more jets per millimeter, it is very difficult to provide charging electrodes of sufficient accuracy and properly connected to their respective leads but insulated from one another.

Such electrodes and leads have previously been prepared by expensive and tedious photoresist and etching techniques, but these have not been entirely successful in providing clearly defined edges to the very narrow and narrowly spaced electrodes and leads.

SUMMARY OF THE INVENTION

In accordance with a first apsect of the present invention, a method of forming a charging electrode assembly for a continous multi-jet ink jet printer, the electrode assembly including a substrate plate of electrically insulating material provided with a series of parallel electrodes extending across an edge of the plate and a series of parallel strip leads extending across a face of the plate, each lead being aligned with and terminating at a respective one of the electrodes; comprises providing a layer of metal plating over at least the edge and the face of the plate, and removing portions of the plating material to leave the electrodes and leads, the boundary edges of the electrodes and leads being delimited by removing the plating portions so as to leave, at each boundary edge, the plating only on one of two surface portions of the substrate material which surface portions intersect at a corner edge of the substrate material formed by the intersection of the edge or face of the plate with a side of a respective one of a series of grooves cut in and across the edge and face of the plate parallel to the electrodes and leads.

The grooves may be cut before or after the plating. Thus in one application of the invention, the series of parallel grooves are cut in and across the face of the substrate plate, at least the edge and face of which are then metal plated. The edge and face are then ground to remove the metal plating from the edge and face, except in the grooves in which the electrodes and leads are formed by the residual metal plating.

If the electrode assembly is of comb-shaped kind, in which the jets pass through respective notches defined between adjacent pairs of teeth of the comb, the series of slots in the plate edge will be a series of notches which will be lined with the metal plating, the grinding removing excess metal from the exposed edges of the comb teeth between the notches.

In an alternative application of the invention, the grooves may be cut after the edge and face of the substrate plate have been provided with a layer of metal plating. The grooves will then be deep enough to cut through the layer of metal plating and extend slightly into the substrate material, leaving the electrodes and leads in the lands between the grooves. Indeed, it would be possible to combine the two alternative techniques and to produce the electrodes in pregrooved portions of the plate edge and the leads between post grooved portions of the plate face, or vice versa.

In all cases, however, the grooves can be cut very accurately in the plate, which may be made of a ceramic material, so that the electrode assembly can be prepared comparatively simply with a good guarantee that the edges of the electrodes and leads will be clearly defined with small tolerances.

The opposite face of the plate may also be provided with a layer of metal plating, in which case at least that metal plating on that face is ground off so that it is spaced from the metal of the electrodes, the remaining metal layer on that face being useful for earthing purposes.

It is important that the ink jets are aligned absolutely correctly with the respective electrodes, particularly centrally with the notches of a comb-shaped charging electrode. This cannot be assured by normal assembly procedures and some degree of fine adjustment is desirable.

In accordance with a second, independent aspect of the invention, but which is applicable to a charging electrode assembly formed as described above, a charging electrode assembly comprises an electrically insulating substrate plate having a series of electrodes in a nominal front edge, the electrodes being connected to respective ones of an array of metallic leads extending from front to rear across a nominal top face of a plate, the plate being mounted for adjustment parallel to its plane by means of a pair of dowels working in elongate slots extending through the plate one adjacent to each side of the plate, the length of the slots being substantially parallel to the front edge of the plate, and a third, eccentric, dowel working in an aperture adjacent to the rear edge of the plate, whereupon rotation of the third dowel causes adjustment of the plate from side to side.

Adjustment in the fore and aft direction may also be provided if the first and second dowels are eccentric dowels and the aperture for the third dowel is also an elongate slot, with its length in the fore and aft direction.

This arrangement provides very simply a fine adjustment for the charging electrode assembly relatively to the planar array of jets, the positions of which will be fixed by the usual stationary nozzle plate.

BRIEF DESCRIPTION OF THE DRAWINGS

The two aspects of the invention are illustrated by way of example in the accompanying drawings, in which.

DETAILED DESCRIPTION OF THE INVENTION

Figure 2:
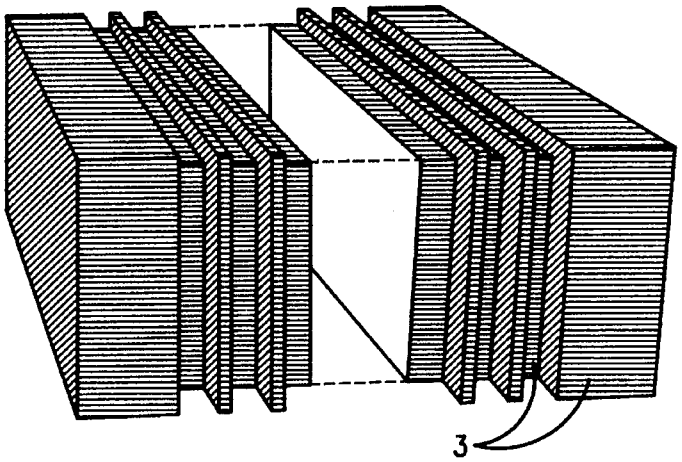
FIGS. 1 to 3 are perspective views showing the sucessive steps in producing parallel electrodes and strip leads.
Figure 1:
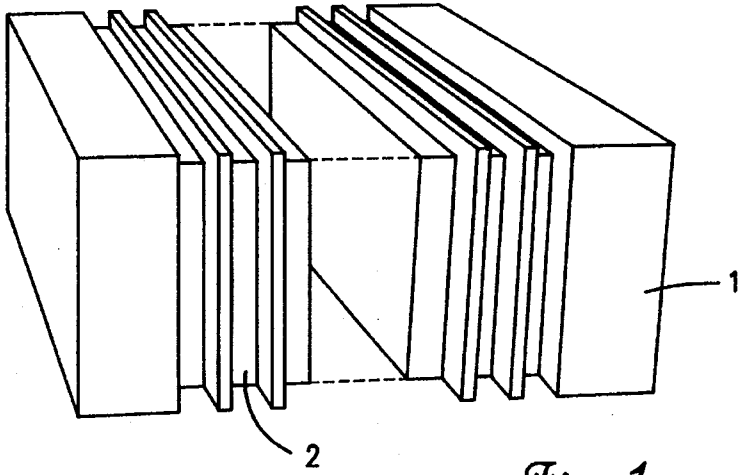
Figure 3:
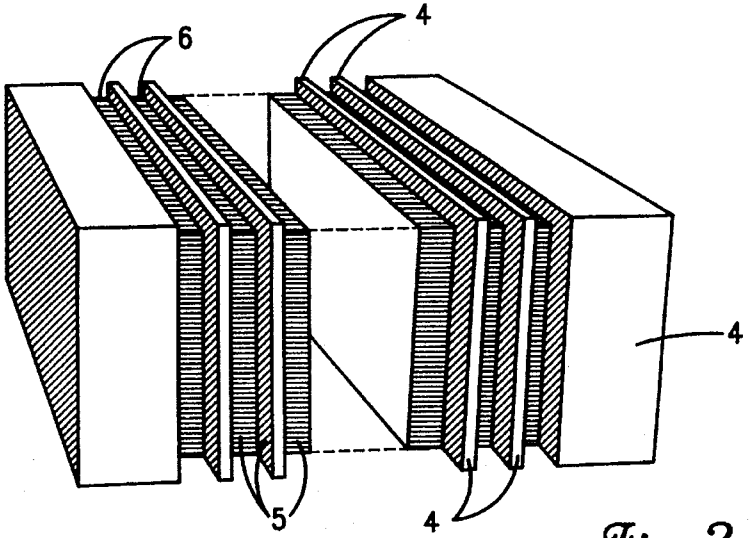

FIG. 1 shows a block-like plate 1 of electrically insulating substrate material which has been formed across its nominal front edge and nominal upper face with a series of grooves 2. The plate of FIG. 1 is subsequently plated with a layer of metal shown by the darker hatched surface 3 in FIG. 2, the plating covering both the grooved and ungrooved portions of the plate. The surfaces of the plate are then ground to a depth greater than the thickness of the metal plating, to reveal the substrate material other than in the grooves 2, thereby leaving a series of parallel comb electrodes 5 in the edge of the plate leading to strip leads 6 in the upper face of the plate. As shown in FIG. 3, the electrodes 5 of adjacent pairs, and the strip leads 6 of adjacent pairs, are separated by electrically insulating strips of the exposed substrate material.

Figure 4:
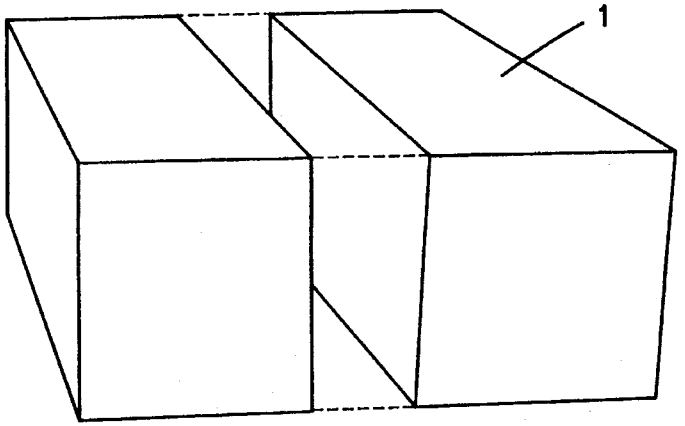
FIGS. 4 to 6 correspond to FIGS. 1 to 3 but show an alternative series of steps; and, FIGS. 7 and 8 are plan views of two electrode assemblies.
Figure 6:
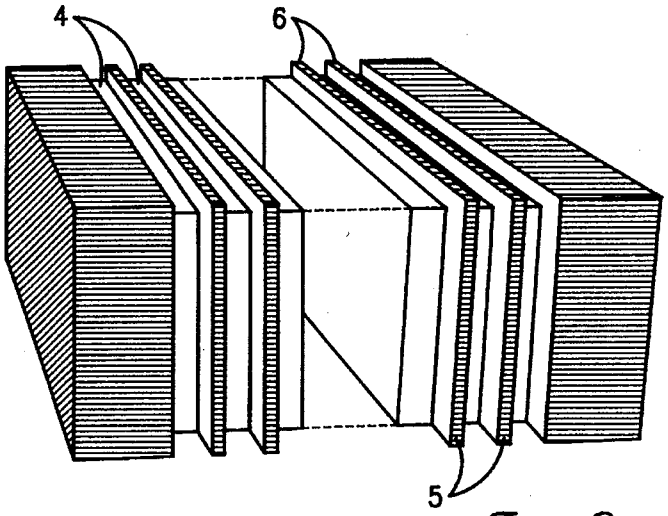
Figure 5:
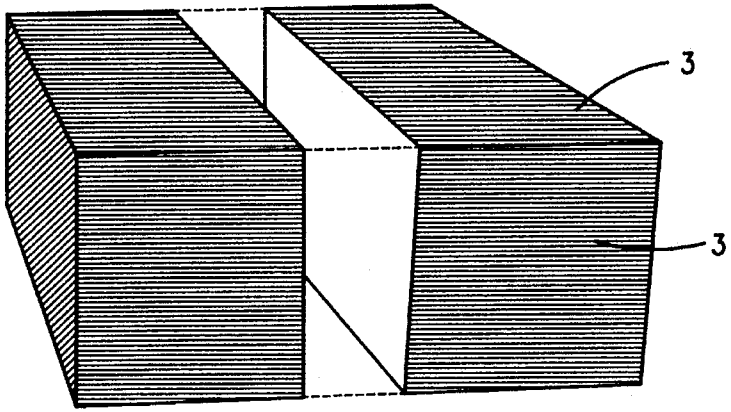

FIGS. 4 to 6 shown an alternative method in which the electrically insulating block-like substrate plate 1 is first plated with a layer of metal 3 and then grooves 4 are cut across the front edge and top face of the plate as shown in FIG. 6. The grooves are deeper than the metal layer so that the substrate material is exposed in the grooves, leaving, across the edge of the plate, strip electrodes 5 and, across the top face of the plate, strip leads 6.

Figure 7:
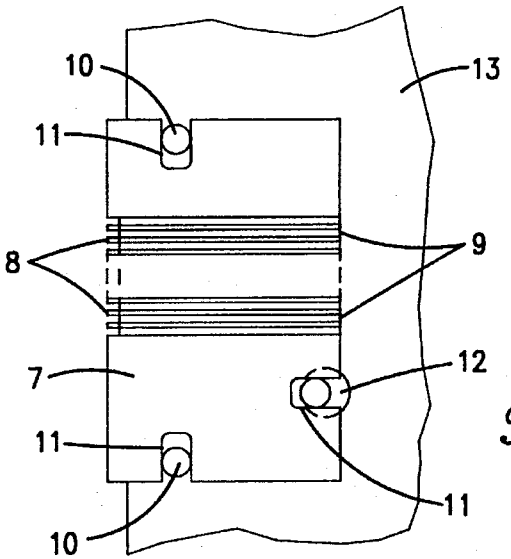

FIG. 7 shows a charging electrode assembly consisting of a block-like plate 7 carrying, across its front edge, electrodes 8, and across its top face, strip leads 9, which may be formed similarly to the electrodes 5 and strip leads 6 as described with reference to FIGS. 1 to 3 or to FIGS. 4 to 6. The plate is formed with three elongate slots 11 and is adjustable relatively to a supporting plate 13 by means of dowels 10 and 12 which extend through the slots 11 and the diameters of which are substantially the same as the width of the slots. The dowel 12 is an eccentric dowel and rotation of this dowel causes the plate to move from side to side, guided by the dowels 10, to provide sensitive adjustment parallel to the length of the plate 7, between the electrodes 8 and corresponding trains of droplets emanating from the nozzle plate of the ink jet printer.

Figure 8:
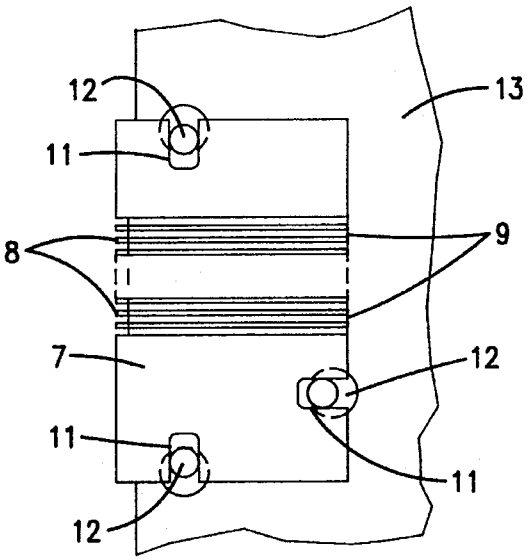

FIG. 8 shows a modification in which the dowels 10 are replaced by further eccentric dowels 12, whereby simultaneous rotation of these two dowels causes the plate to be guided by the other dowel and slot for adjustment perpendicular to the length of the plate 7.

What is claimed is:

1. A method of forming a charging electrode for a continuous multi-jet ink jet printer, the electrode assembly including a substrate plate of electrically insulating material provided with a series of parallel electrodes extending an edge of the plate and a series of parallel strip leads extending across a face of the plate, each said lead being aligned with and terminating at a respective one of the electrodes; the method comprising the steps of;

forming a series of parallel spaced grooves in and across said edge;

forming a series of parallel spaced grooves in and across said face; and providing a layer of metal plating over at least the edge and the face of the plate to form the electrodes and leads, the boundary edges of the electrodes and leads being delimited by a corner edge of the substrate formed by the intersection of the edge or face of the plate with a side of a respective one of said grooves.

2. A method according to claim 1, wherein at least one of said steps of forming said parallel grooves is executed prior to said step of metal plating, and further comprising the step of removing said metal plating from the edge and the face, except in the grooves.

3. A method as in claim 2, wherein both said steps of forming said grooves are performed prior to said step of providing a layer of metal plating.

4. A method according to claim 1, wherein at least one of said steps of forming the grooves is executed subsequent to said step of providing a layer of metal plating, and wherein said step of forming grooves includes cutting deep enough to cut through the layer of metal plating and slightly into the substrate plate.

5. A method as in claim 4, wherein both said steps of forming said grooves are performed subsequent to said step of providing a layer of metal plating.

6. A method according to claim 1, 2 or 3, 4 wherein an opposite face of the plate is also provided with a layer of metal plating; at least the metal plating on the opposite face is ground off so that it is spaced from the metal of the electrodes.

7. A charging electrode assembly when formed by a method according to claim 1.

8. A charging electrode assembly comprising an electrically insulating substrate plate (7) having a series of electrodes (8) in a nominal front edge, the electrodes being connected to respective ones of an array of metallic leads (9) extending from front to rear across a nominal top face of a plate, the plate being mounted for adjustement parallel to its plane by means of a pair of dowels (10) working in elongate slots (11) extending through the plate one adjacent to each side of the plate, the length of the slots being substantially parallel to the front edge of the plate, and a third, eccentric, dowel (12) working in an aperture (11) adjacent to the rear edge of the plate, whereupon rotation of the third dowel causes adjustment of the plate from side to side (FIGS. 7 and 8).

9. An assembly according to claim 8, wherein the first and second dowels are eccentric dowels (12) and the aperture for the third dowel is also an elongate slot, with its length in the fore and aft direction (FIG. 8).

10. A method of forming a charging electrode assembly for a continuous multi-jet ink jet printer, the electrode assembly including a substrate plate of electrically insulating material provided with a series of parallel electrodes extending across and edge of the plate and a series of parallel strip leads extending across a face of the plate, each lead being aligned with and terminating at a respective one the electrodes, the method comprising the steps of:

cutting a series of parallel grooves in and across at least one of the edge and face of the substrate plate;

providing a layer of metal plating over at least the edge and the face of the plate; and removing the metal plating from the edge and the face, except in the grooves, so as to define the electrodes and/or leads by the residual metal plating remaining within the grooves.

11. A method of forming a charging electrode assembly for a continuous multi-jet ink jet printer, the electrode assembly including a substrate plate of electrically insulating material provided with a series of parallel electrodes extending across and edge of the plate and a series of parallel strip leads extending across a face of the plate, each lead being aligned with and terminating at a respective one the electrodes, the method comprising the steps of:

providing a layer of metal plating over at least the edge and the face of the plate; and cutting a series of parallel grooves in and across at least one of the edge and face of the substrate plate, the grooves being of a depth sufficient to cut through the layer of metal plating so as to leave the electrodes and/or leads upon lands between the grooves.

* * * * *